United States Patent [19]

Beach et al.

[11] Patent Number: 4,836,603

[45] Date of Patent: Jun. 6, 1989

[54] TREATMENT CHAIR ASSEMBLY

[75] Inventors: Daryl R. Beach, Atami; Kazuo Hayashi, Kyoto, both of Japan

[73] Assignee: Kabushiki Kaisha Morita Seisakusho, Kyoto, Japan

[21] Appl. No.: 190,000

[22] Filed: May 4, 1988

[30] Foreign Application Priority Data

May 29, 1987 [JP] Japan ..... 62-137189

[51] Int. Cl.[4] ..... A47C 7/62

[52] U.S. Cl. ..... 297/193; 297/314; 297/331; 297/344

[58] Field of Search ..... 297/314, 335, 334, 331, 297/344, 188, 193

[56] References Cited

U.S. PATENT DOCUMENTS

| | | | |
|---|---|---|---|
| 3,463,542 | 8/1969 | Daniels | 297/331 X |
| 3,927,727 | 12/1975 | Hanagan | 297/193 |
| 4,413,858 | 11/1983 | Beach | 297/188 |
| 4,696,508 | 9/1987 | Brautigam | 297/344 |

FOREIGN PATENT DOCUMENTS

| | | | |
|---|---|---|---|
| 2159869 | 6/1973 | Fed. Rep. of Germany | 297/314 |
| 22805 | of 1907 | United Kingdom | 297/193 |

*Primary Examiner*—Francis K. Zugel

*Attorney, Agent, or Firm*—Koda and Androlia

[57] ABSTRACT

A treatment chair assembly comprising a treatment chair and a chair base, the chair assembly being pivotally or swingably connected to a chair base, in which a chair elevating mechanism is housed, so that the chair can be turned upward from and downward to the chair base. With this treatment chair assembly, it is not necessary to separate the treatment chair from the chair base and move the treatment chair to a different place when the chair elevating mechanism and the instrument drive/control unit are maintained, checked or repaired. The treatment chair can be turned upward by pivoting or swinging without separating and moving the treatment chair. As a result, labor can be saved and no space is required to temporarily store the treatment chair. The space for a dental treatment room can be used effectively. Furthermore, since the chair is not separated or moved, less concern for staining or breaking the chair due to bumping against objects is necessary.

3 Claims, 4 Drawing Sheets

TREATMENT CHAIR ASSEMBLY

BACKGROUND OF THE INVENTION

1. Field of the Invention

The present invention relates to a chair assembly (for dental and other medical treatment) comprising a treatment chair and a chair base which houses a chair elevating mechanism such as a hydraulic cylinder and is placed on the floor.

2. Prior Art

Generally, the treatment chair of the treatment chair assembly of this kind is constructed to be completely removable from the chair base.

The treatment instrument holding section, treatment instrument tube holding section, instrument drive/control unit, etc. of the treatment chair assembly are built in the chair base.

The above-mentioned conventional treatment chair assembly has a mechanism disposed between the chair base and the treatment chair to prevent the treatment chair from becoming loose and dislocating when a patient gets on and off the treatment chair during normal treatment. When it is necessary to maintain, check or repair the chair elevating mechanism or the instrument drive/control unit, the treatment chair, which is a large wide board covered with a cushion, must be removed from the treatment chair base and placed at a different position. This requires a great deal of labor and the treatment chair occupies a large space in a treatment room. The removed treatment chair may be stained or broken.

The treatment chair is interchangeable with that for a different chair base, since the instrument drive/control unit is housed in the chair base. However, this interchangeability is not obtained for chair bases having instrument drive/control units for different instruments. A specific instrument is usually used for one treatment chair assembly.

Furthermore, since the instrument tubes and the instrument holding sections are complicatedly built in the chair base, simple sterilization using alcohol for example is possible, but complete sterilization is difficult. This is not good for sanitation.

SUMMARY OF THE INVENTION

In view of the prior art described above, it is an object of the present invention to provide a treatment chair assembly which can be maintained, checked and repaired easily and efficiently without staining or breaking the chair. Another object of the present invention is to provide a treatment chair assembly wherein instruments can be used interchangeably and sterilization can be easily conducted to ensure very effective sanitation.

To achieve the first object, the first invention relates to a treatment chair assembly comprising a treatment chair and a chair base in which a chair elevating mechanism is housed, and being characterized in that the treatment chair is pivotally or swingably connected to the chair base so that the treatment chair can be turned upward from and downward to the chair base.

To achieve the above-mentioned second object, the second invention relates to a treatment chair assembly comprising a treatment chair and a chair base in which a chair elevating mechanism is housed, and being characterized in that the treatment chair is pivotally or swingably connected to the chair base so that the treatment chair can be turned upward from and downward to the chair base, that treatment instruments and instrument tubes are held at the shoulder section on the bottom of the treatment chair, and that treatment instrument drive/control unit is installed on the bottom of the treatment chair. treatment chair.

With the first invention having the structure described above, the chair elevating mechanism and the instrument drive/control unit for example can be maintained, checked or repaired only after the treatment chair is turned upward pivotally or swingably ("pivotally" is used hereafter) from the treatment chair base. It is not necessary to completely remove the treatment chair and placing the chair at a different position. Much labor is not required for maintenance and check. No extra space is necessary to temporarily store the treatment chair (which needs to be removed in the case of the conventional chair). The treatment chair can thus be prevented from being stained or broken. With the second invention having the structure described above, the treatment instruments, instrument tubes and drive/control unit are installed on the bottom of the treatment chair which can be turned upward pivotally from the treatment base. Therefore, when the treatment chair is turned upward pivotally, the instruments are exposed sideways or upward and can be sterilized easily and completely. Moreover, since the treatment instruments and the drive/control unit are installed on the chair, one type of instrument can be used with a plurality of treatment bases by installing the chair on different chair bases.

These two inventions are described below referring to the accompanying drawings.

DETAILED DESCRIPTION OF THE INVENTION

Figure 1:
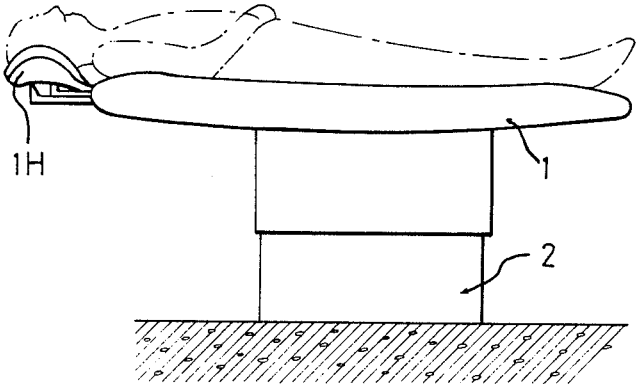
FIG. 1 is a side view of a first embodiment of the present invention.
Figure 2:
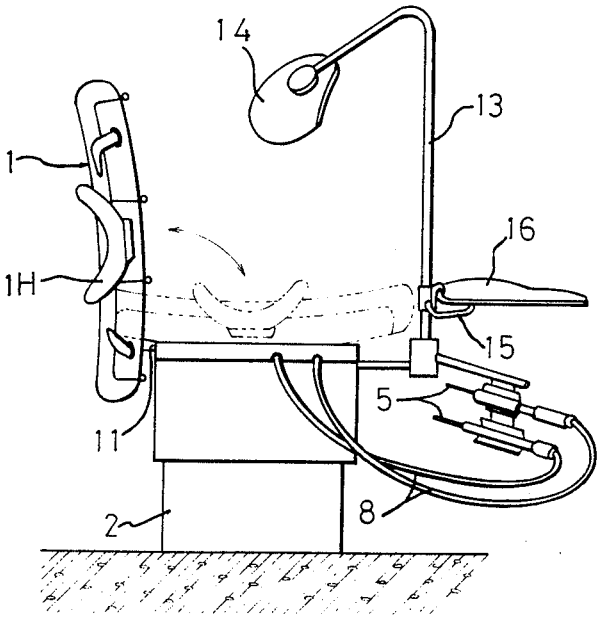
FIG. 2 is a front view of the first embodiment of the present invention.
Figure 3:
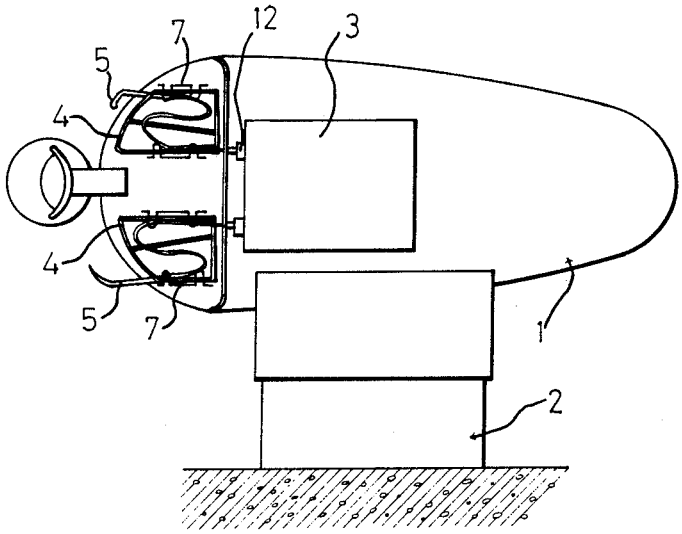
FIG. 3 is a side view illustrating the upward-turned treatment chair of the first embodiment.
Figure 4:
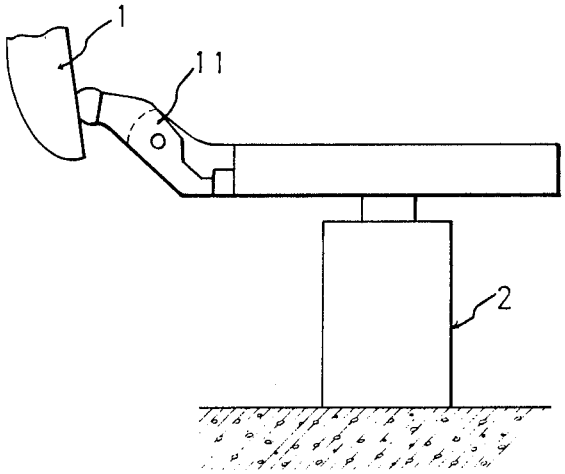
FIG. 4 is an enlarged front view of the major section of the first embodiment.

According to FIGS. 1 and 3, numeral 2 designates a treatment chair base placed on the floor wherein the chair elevating mechanism (not shown) comprising a combination of a hydraulic cylinder, screw shaft or electric motor. Numeral 1 designates a treatment chair having the shape of an almost horizontal bed. The treatment chair 1 is pivotally connected to the treatment chair base 2 via a hinge 11 on one longitudinal side of the chair 1 so that the treatment chair 1 can have two postures (indicated by solid and chain lines in FIG. 2): an upright posture almost vertical to the chair base 2 and a lying posture over the chair base 2. A headrest 1H is disposed at the end of the treatment chair 1.

Figure 5:
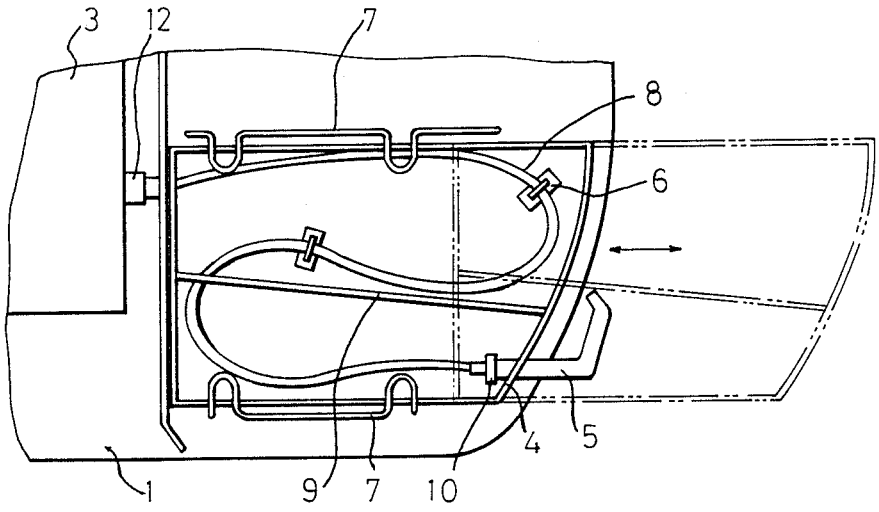
FIG. 5 is an enlarged side view of the major section of FIG. 3.
Figure 7:
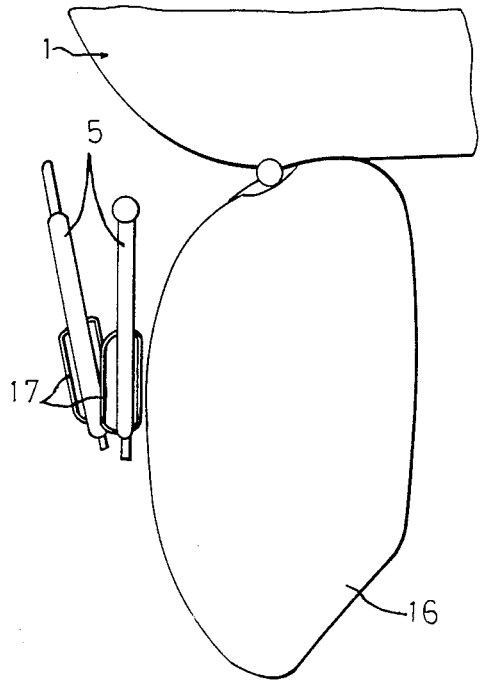
FIG. 7 is an enlarged horizontal sectional plan view taken on line VII—VII of FIG. 6.

Numeral 5 designates a treatment instrument and numeral 8 designates a tube connected to the instrument 5. The instrument and tube are secured by a holding section 4. The holding section 4 having the shape of a box as shown in FIG. 5 is disposed at the shoulder section on the bottom of the treatment chair 1 and can slide back and forth for removal and installation via a slide guide 7 made of wire. The tube 8 is secured by tube holder 6, a support rod 9 and a holding ring 10 so that the tube 8 does not drop. Furthermore, the tube 8 can be smoothly extended from the holding section 4 as shown by the chain lines in FIG. 5 when the instrument 5 is pulled out. Moreover, the tube 8 can be accommodated in a bent form as shown by the solid lines in FIG. 5 by a slight pushing force of the operator and the self-resilient restoring force of the tube. Numeral 3 designates the drive/control unit for the instrument 5. This drive/control unit 3 is installed on the bottom of the treatment chair 1 just behind the holding section 4. The one end of the tube 8 is disconnectably connected to the drive/-control unit 3 via an easy connection joint 12.

Figure 6:
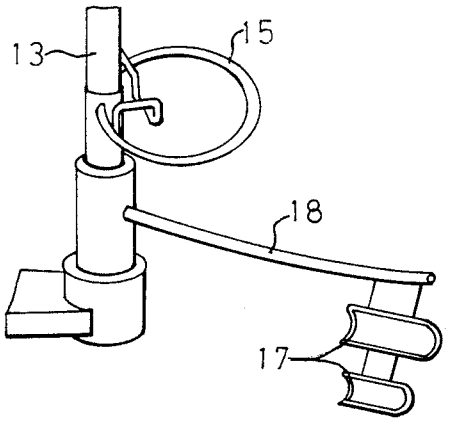
FIG. 6 is a perspective view of the major section of the first embodiment.

Numeral 13 designates a fixed pole extended upward from the chair base 2 (at a position close to the head of a patient). At the top of the pole 13, a light 14 is installed to cast light to an affected part. At the position close to the root of the pole 13, a tray holder 15 made of wire is installed as shown in FIG. 6. A tray 16 is removably installed on this holder 15. Numeral 17 designates an instrument holder. At the free end of a stay 18 extended sideways and forward from the lower end of the pole 13, a plurality of the instrument hoders 17 (three or more instrument holders can be used although two instrument holders are shown in FIG. 6) are arranged vertically. These instrument holders 17 are also simply made of wire, and inclined at different angles so that a plurality of the instruments 5 can be easily hooked and removed on one side of the tray 16.

With the treatment chair 1 having the above-mentioned structure, the elevating mechanism built in the chair base 2, the instruments 5 and the drive/control unit 3 installed on the bottom of the treatment chair 1 can be maintained, checked or repaired easily after the treatment chair 1 is turned upward almost vertical to the chair base 2 as shown by the solid lines of FIG. 2. The holding section 4 can be removed from the bottom of the treatment chair 1 and moved to a different place so that the holding section 4 can be sterilized completely and easily. In addition, since the tray holder 15 and the instrument holder 17 are simply made of wire, they can also be sterilized easily.

Figure 8:
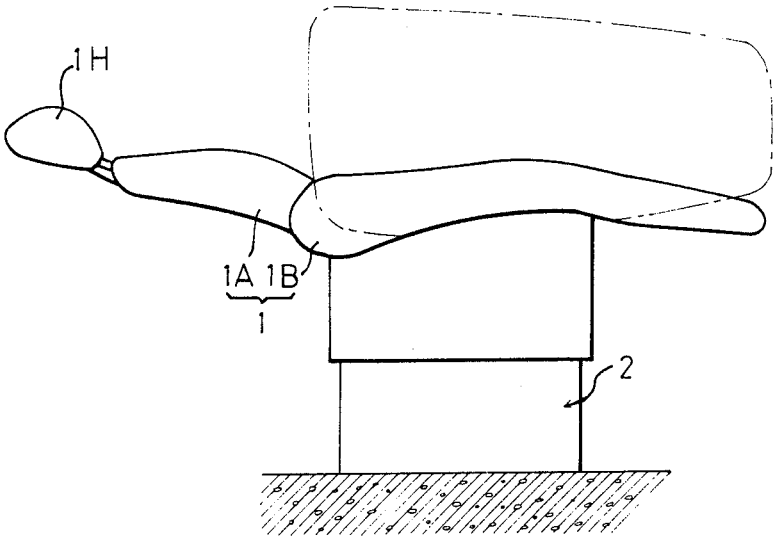
FIG. 8 is a side view illustrating another embodiment.

FIG. 8 shows another embodiment of the present invention. The treatment chair 1 (backrest 1A and chair 1B or backrest 1A) can be pivotally turned upward easily from the treatment base 2 in the same way as that for the above-mentioned embodiment.

Figure 9:
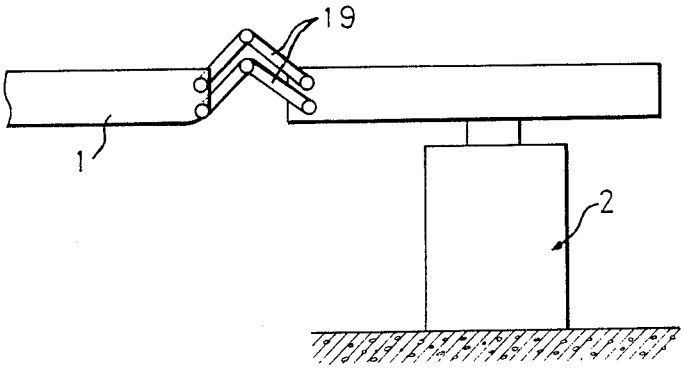
FIG. 9 is a partially cutaway front view of a third embodiment.
Figure 10:
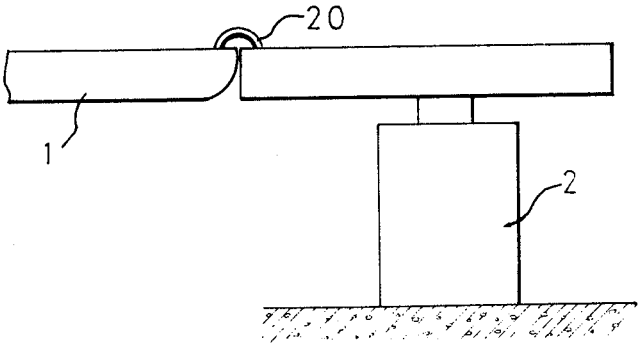
FIG. 10 is a partially cutaway front view of a fourth embodiment.

FIGS. 9 and 10 show other embodiments of the present invention. The treatment chair 1 of the embodiment shown in FIG. 9 is pivotally turned upward from and downward to the chair base 2 via a parallel link mechanism 19. The treatment chair 1 of the embodiment shown in FIG. 10 is pivotally turned upward from and downward to the chair base 2 via a belt 20 such as a leather belt.

The present invention includes an embodiment wherein the treatment chair 1 can be turned upward approximately 180 degrees from the chair base 2 so that the bottom of the treatment chair 1 is placed horizontally and faces upward (not shown).

The present invention also includes a treatment chair which is turned upward and downward by swinging instead of pivoting.

As clearly explained above, in the case of the first invention, it is not necessary to separate the treatment chair 1 from the chair base 2 and move the treatment chair 1 to a different place when the chair elevating mechanism and the instrument drive control unit are maintained, checked or repaired. The treatment chair 1 can be turned upward by pivoting or swinging without separating and moving the treatment chair 1. As a result, labor can be saved and no further space is required to temporarily store the treatment chair 1. The space of a treatment room can be used effectively. Furthermore, since the treatment chair is not separated or moved, less concern for staining or breaking the treatment chair due to bumping against objects is necessary.

In the case of the second invention, since the treatment instruments, instrument tubes and drive/control unit are installed on the bottom of the chair, one type of instrument can be used with a plurality of treatment bases by installing the chair on different chair bases. In addition to this interchangeability feature, sterilization can be made easier by distributing various units to the treatment chair and chair base. Sanitation is thus ensured at all times.

We claim:

1. A treatment chair assembly comprising a treatment chair and a chair base in which a chair elevating mechanism is housed, said treatment chair elevating characterized in that said treatment chair is pivotally connected to said chair base so that said chair can be turned upward from and downward to said chair base; and wherein:

said treatment chair is pivotally connected to said chair base via a hinge on one longitudinal side of said treatment chair to thereby allow said treatment to take two postures, an upward posture almost vertical to said chair base and a lying posture over said chair base;

said treatment chair has an almost horizontal bed-like form;

treatment instruments and instruments are held at a shoulder section on the bottom of said treatment chair; and a holder section for securing said treatment instruments and instrument tubes which slides back and forth in removal and installation at the shoulder section on the bottom of the treatment chair is provided.

2. A treatment chair assembly comprising a treatment chair and a chair base in which a chair elevating mechanism is housed, said treatment chair assembly being characterize in that said treatment chair is pivotally or swingably connected to said chair base so that said chair can be turned upward from sand downward to said chair base, that treatment instruments and instrument tubes and are held at the shoulder section on the bottom of said treatment chair, and that the drive/control unit of said treatment instruments is installed on the bottom of said treatment chair; and wherein:

said treatment chair has almost horizontal bed-like form; and a holding section for securing said treatment instruments and instrument tubes which slides back and forth for removal and installation is provided at the shoulder section on the bottom of said treatment chair.

3. A treatment chair assembly according to claim 2, wherein said tubes of said instruments are disconnectably connected to said drive/control unit via an easy connection joint.

* * * * *